US007740921B2

(12) United States Patent
Zhou et al.

(10) Patent No.: US 7,740,921 B2
(45) Date of Patent: Jun. 22, 2010

(54) MEDIA SHEET

(75) Inventors: Xiao-Qi Zhou, San Diego, CA (US); Hai Q Tran, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 999 days.

(21) Appl. No.: 11/481,461

(22) Filed: Jul. 6, 2006

(65) Prior Publication Data

US 2008/0008846 A1 Jan. 10, 2008

(51) Int. Cl.
*B41M 5/50* (2006.01)

(52) U.S. Cl. ..... 428/32.37; 427/146; 428/32.3; 428/32.34

(58) Field of Classification Search ..... None
See application file for complete search history.

(56) References Cited

U.S. PATENT DOCUMENTS 5,344,487 A 9/1994 Whalen-Shaw
5,454,864 A 10/1995 Whalen-Shaw
5,551,975 A 9/1996 Freeman et al.
5,755,871 A 5/1998 Husson, Sr.
5,997,625 A 12/1999 Londo et al.
6,387,500 B1 5/2002 Behl
6,585,822 B2 7/2003 Berube et al.
6,610,136 B2 8/2003 Malla et al.
6,663,922 B2 12/2003 Ogino et al.
6,991,330 B2 * 1/2006 Maekawa ..... 347/105
7,553,526 B2 * 6/2009 Campbell et al. ..... 428/32.21
2004/0197496 A1 10/2004 Song et al.

FOREIGN PATENT DOCUMENTS

JP 10131093 A 5/1998
WO 01/81078 A 11/2001

* cited by examiner

*Primary Examiner*—Bruce H Hess

(57) ABSTRACT

A media sheet has a substrate with an image-receiving layer disposed thereon. The image-receiving layer has a first pigment having particles with a size of about 50 to about 400 nanometers, a second pigment having plate-like particles, and a third pigment that either having a porous structure with an oil absorption of about 50 to about 300 cubic centimeters of oil per 100 grams, or a porous structure comprising substantially non-porous particles.

21 Claims, 1 Drawing Sheet

MEDIA SHEET

BACKGROUND

Color photographic printing using digital imaging devices, e.g., including electrophotographic and inkjet technologies, normally involves forming color images on media specially formulated for use in digital imaging devices. The most commonly used media for digital printing is paper-based media, because it is relatively inexpensive. In some instances, paper-based media is either specially formulated for use in electrophotographic devices or for use in inkjet devices. Although conventional paper, uncoated can be used as for both electrophotographic and inkjet printing, the print quality is poor. Coated glossy media that can generate high image quality print outs for both inkjet and electrophotographic printing are not common.

DETAILED DESCRIPTION

Figure 1:
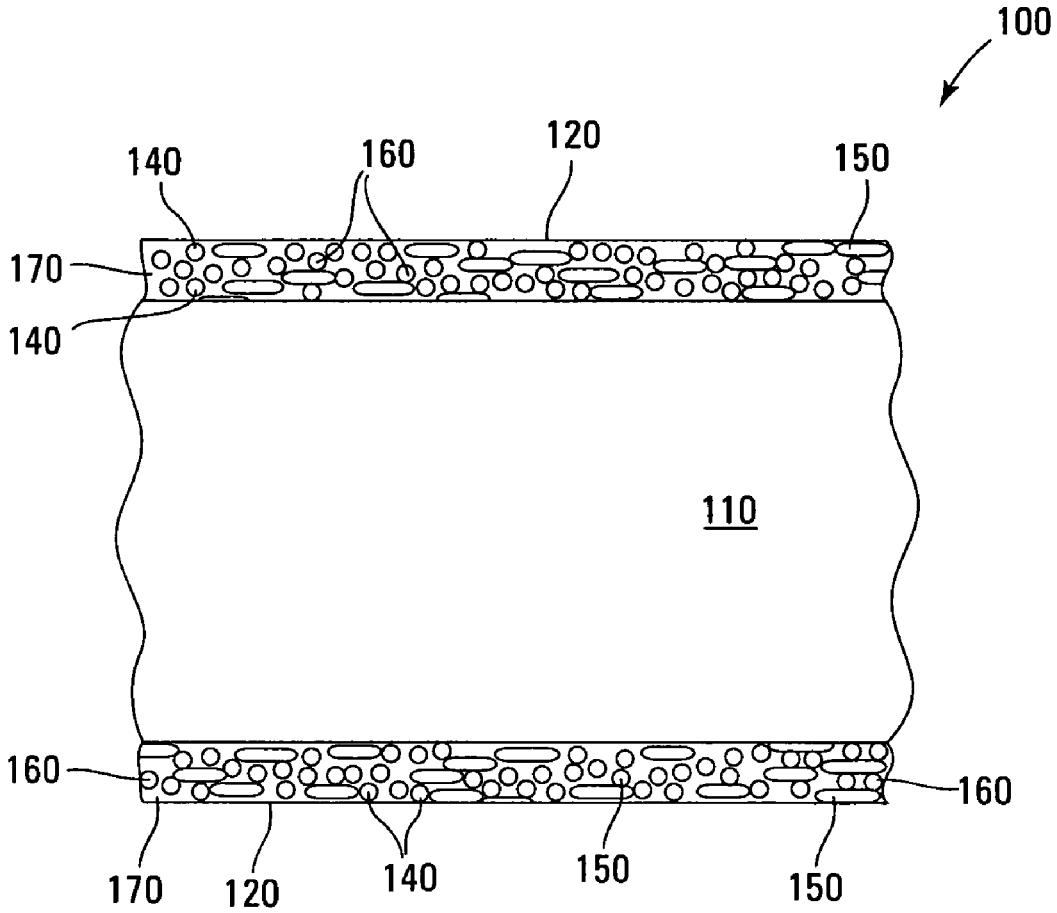
FIG. 1 is a cross-sectional view of an embodiment of a media sheet, according to an embodiment of the invention.

In the following detailed description of the present embodiments, reference is made to the accompanying drawings that form a part hereof, and in which are shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

FIG. 1 is a cross-sectional view of a media sheet 100 suitable for use in digital color imaging devices, such as electrophotographic and/or inkjet imaging devices, according to an embodiment. Media sheet 100 includes a substrate (or base stock) 110. Any kind of cellulose paper stock may be used for substrate 110, such as paper stock made from wood or non-wood pulps. Non-limitative examples of suitable pulps include mechanical wood pulp, chemically ground pulp, chemical-mechanical pulp, thermal-mechanical pulp, recycled pulp and/or mixtures thereof. Fillers may also be incorporated into the pulp, for example, to substantially control physical properties of the final coated media. The filler particles fill in the void spaces of a fiber network of the base stock and result in a denser, smoother, brighter and substantially opaque sheet. Examples of fillers include, but are not limited to, ground calcium carbonate, precipitated calcium carbonate, titanium dioxide, kaolin clay, silicates, plastic pigment, alumina trihydrate, and/or mixtures thereof. In one exemplary embodiment, the amount of filler ranges from about 0.1 to about 20 percent of the weight of the substrate, and in another embodiment, the amount of filler ranges from about 5 to about 15 percent of the weight of the substrate. For one embodiment, substrate 110 may be in a form suitable for use in, but not limited to, newsprint, magazine stock, copy paper, cast coating, blade, rod, curtain and slot coating or size press coating.

Substrate 110 may include sizing agents. The sizing agent acts to improve internal bond strength of the substrate fibers, which is a critical factor to get a blistering-free performance when it subjected to toner fusing at elevated temperature during electrophotographic printing. The sizing also controls the resistance of the coated substrate to wetting, penetration, and absorption of aqueous liquids, such as include in inks as ink vehicles (or carriers). Non-limitative examples of suitable sizing agents include rosin-based sizing agent(s), wax-based sizing agent(s), cellulose-reactive sizing agent(s) and other synthetic sizing agent(s), and/or mixtures thereof. Functional additives, such as but not limited to dispersants, biocides, retention aids, defoamers, dyes, and optical brighteners, may be added to substrate 110.

An image-receiving layer (or coating) 120 is formed on substrate 110. For one embodiment, image-receiving layer 120 is formed either on opposing (upper and lower or wire and felt) surfaces of substrate 110, as shown, or one of the surfaces of substrate 110. For one embodiment, image-receiving layer 120 has a gloss level of about 35 to about 70 percent, as measured at a TAPPI (Technical Association of the Pulp and Paper Industry) angle of 75 degrees.

Image-receiving layer 120 includes a pigment having pigment particles 140. Pigment particles 140 act to increase a solid content of a liquid coating solution that forms image-receiving layer 120, while maintaining a suitably low viscosity of the liquid coating solution, e.g., such that the liquid coating solution can be applied by surface-sizing equipment. This means that for some embodiments, the coating can be applied as part of a surface-sizing step. Increasing the solid content of the coating solution acts to increase the coat weight that in turn acts to increase the gloss level of image-receiving layer 120, e.g., to gloss levels attainable with coating viscosities that are too high to be used in conventional surface-sizing equipment. Increasing the solid content of coating solution also acts to decrease a dry time of image-receiving layer 120 after it is formed and allows lower temperature levels to be used during heated drying and a faster running speed of the coated substrate during heated drying. For one embodiment, the pigment having pigment particles 140 has an oil absorption of less than about 60 grams per 100 grams of the pigment.

For one embodiment, pigment particles 140 may be spherical, cubical, or isometric particles. The aspect ratio of pigment particles 140 is about 1 to about 5 for one embodiment. For another embodiment, the average size of pigment particles 140 is about 50 to about 400 nanometers. These morphologies and particle sizes enable the coating solution to have a relatively low viscosity that can be easily applied on substrate 110. The relatively low viscosity and high solid content is advantageous in coating processes, e.g., involving surface-sizing presses, having a narrow processing window that limits the viscosity of the coating solution.

Because the particle size of pigment 140 is in sub-micrometer range, a portion of pigment particles 140 may enter voids in the surface of substrate 110 under a nip pressure of the application head that applies the coating. Partially filling voids in the substrate acts to reduces ink bleeding caused by capillary-induced spreading of marking materials, such as color inks received on image-receiving layer 120 during printing.

For one embodiment, pigment particles 140 are inorganic pigment particles received in a dry-powder form or as an aqueous suspension. Non-limiting examples of materials for pigment particles 140 include titanium dioxide, hydrated alumina (e.g. aluminum trihydrate), calcium carbonate, barium sulfate, alumina, zinc oxide, and/or various combinations thereof. For another embodiment, pigment particles 140 form about 10 to about 50 percent of image-receiving layer 120 by weight.

Image-receiving layer 120 includes another pigment having pigment particles 150 that for one embodiment are platelets (or plate-like structures). Pigment particles 150 perform a "covering" function for covering the fibers in the surface of substrate 110.

Note that the quality of digital printing typically depends on the smoothness, both in micro and larger scale, of the media surface and the ability of the media to absorb ink or to evenly distribute toner to give high gloss uniformity. However, base stock, such as substrate 110, typically has a non-uniform surface roughness, owing to a non-uniform distribution of surface fibers, and a non-uniform porosity. Note that the wire side and felt side of substrate 110 have different surface roughnesses.

The covering function of pigment particles 150 acts to reduce the non-uniformity in the surface roughness of the base stock, while providing suitable ink absorption or toner adhesion. Pigment particles 150 further act to increase the opacity, brightness, whiteness, glossiness, and surface smoothness of image-receiving layer 120. Increasing the opacity reduces the likelihood of an image formed on one side of the media sheet from being visible on an opposite side of the media sheet. For other embodiments, the plate-like shape of pigment particles 150 acts to control the degree and rate of liquid ink, e.g., an ink vehicle (or carrier), such as water, and a colorant dissolved or suspended in the ink vehicle, migration into the substrate 110. Pigment particles 150 act to retain the colorant and the ink vehicle of the marking material at or near an outer surface of image-receiving layer 120. Note that retention of the colorant at or near the outer surface of image-receiving layer 120 is desirable, whereas retention of the ink vehicle at or near the outer surface of image-receiving layer 120 is typically undesirable. Retention of the colorant and ink vehicle at or near the outer surface of image-receiving layer 120 is discussed further below. Pigment particles 150 also act to improve the flow of the liquid coating that forms image-receiving layer 120 during surface sizing process where it is applied to the surface of substrate 110.

For one embodiment, pigment particles 150 are inorganic particles, such as aluminum silicate. For another embodiment, pigment particles 150 have a median ESD (equivalent spherical diameter) of about 0.9 micron to about 1.6 microns as determined by a Microtrac-UPA 150 laser light scattering device. For other embodiments, not more than 5 percent by weight have an ESD greater than 4.5 microns, but desirably not more than 10 percent of the particles have an ESD smaller than 0.3 microns. The higher percentage of small ESD particles tend to reduce covering effect of pigment particles 150. The aspect ratio of pigment particles 150, the ratio of the ESD of pigment particles 150 to their average thickness, ranges from about 10 to about 50. For one embodiment, pigment particles 150 may be pre-dispersed into a filter-cake slurry with solid content of about 60 to about 70 percent by weight before loading into the coating solution for image-receiving layer 120. For another embodiment, pigment particles 150 form about 20 to about 60 percent of image-receiving layer 120 by weight.

Image-receiving layer 120 includes yet another pigment having pigment particles 160. Pigment particles 160 act to control the porosity of image-receiving layer 120. This function is important when media sheet 100 is used for inkjet printing in that pigment particles 160 act to absorb an ink vehicle (or carrier), e.g., typically water, of the inkjet ink and act to retain colorant of the ink due to their relatively large surface area at or near the outer surface of image-receiving layer 120. Keeping the colorant of the ink at or near the outer surface of image-receiving layer 120 acts to increase optical density, color gamut, and ink gloss level.

For one embodiment, pigment particles 160 are structured kaolin clay particles. Structured kaolin clay particles may be formed by subjecting hydrous clays to calcinations at an elevated temperature or to chemical treatments, as known in the art. This binds the clay particles to each other to form larger aggregate clay particles and thus acts to increase the void volume. The porous structure of the pigments 160 also enhances the light scattering that improves the opacity and brightness of imaging-receiving layer 120.

Other examples of materials of pigment particles 160 may include structured clays that are reaction products of kaolin clays with colloidal silica. Optionally inorganic particles such as particles of titanium dioxide ($TiO_2$), silicon dioxide ($SiO_2$), aluminum trihydroxide (ATH) calcium carbonate ($CaCO_3$) and zirconium oxide ($ZrO_2$), can be intercalated into the structured clay. For one embodiment, pigment particles 160 may be substantially non-porous mineral particles that have a special morphology that can produce a porous coating structure when solidified into a coating layer. One example of such particles is aragonite precipitated calcium carbonate. These particles have a needle-like structure in micrometer scale, i.e., they have a high aspect (length-to-width) ratio. This structure results in loose coating layer packing, with a relative large fraction of voids on the coating surface.

For another embodiment, a pigment having pigment particles 160 has an oil absorption of about 50 cubic centimeters (cc) to about 300 cc of oil per 100 grams of the pigment, as determined according to American Society of Testing and Materials (ASTM) standard ASTM D 281-95. For a preferred embodiment, the pigment has an oil absorption of about 50 cc to about 160 cc of oil per 100 grams of pigment, as determined according to American Society of Testing and Materials (ASTM) standard ASTM D 281-95. For another embodiment, the porous structure is produced by solidification of the substantially non-porous mineral particles. These particles have an aspect ratio of about 20 to about 250, with a preferable range being between about 40 to about 180. In one embodiment, the median ESD (equivalent spherical diameter) particle size of the substantially nonporous particles is about 0.1 to about 0.8 micrometers. In another embodiment, the ESD is about 0.2 to about 0.5 micrometers. For other embodiments, the porous pigments and substantially nonporous pigments form porous coating during solidifying.

The amount of pigment particles 160 and pigment particles 150 should be properly balanced within image-receiving layer 120 in that pigment particles 160 act to absorb an ink vehicle and pigment particles 150 act to retain an ink vehicle at or near an outer surface of image-receiving layer 120. The proportion of pigment particles 160 to pigment particles 150 should also be adjusted according to the absorption properties of substrate 110. For example, substrates (or base stock) that are heavily surface sized with a closed structure and have relatively poor moisture absorptivity should have a higher proportion of pigment particles 160. For one embodiment, pigment particles 160 form about 20 to about 50 percent of image-receiving layer 120 by weight. For another embodiment, pigment particles 160 have an average particle size (ESD) of about 0.3 micron to about 2.0 microns.

For another embodiment, image-receiving layer 120 may also include one or more binders 170, such as water-soluble binders, water-dispersible binders, e.g., polymeric emulsions exhibiting high binding power for substrate 110 and the pigments, and/or various combinations thereof. Non-limiting examples of suitable binders may include polyvinyl alcohol, starch derivatives, gelatin, cellulose derivatives, acrylamide polymers, acrylic polymers or copolymers, vinyl acetate latex, polyesters, vinylidene chloride latex, styrene-butadiene, acrylonitrile-butadiene copolymers, styrene acrylic copolymers and copolymers and/or various combinations thereof. Other additives, such as colorants, optical brighteners, defoamers, wetting agents, rheology modifiers, dispersants, and other additives known in the art may be added for some embodiments.

For some embodiments, image-receiving layer 120 may include at least one marking material fixative that can chemically, physically, and/or electrostatically bind the marking materials at or near the outer surface of image-receiving layer 120 to obtain high degree of water-fastness, smear-fastness, and overall image stability. For one embodiment, the fixative may be a cationic polymer, such as a polymer having a primary or secondary or a tertiary amino group and a quaternary ammonium salt group or a quaternary phosphonium salt group. In another embodiment, the fixative may include polyguanidine compounds. The fixative may be received in a water-soluble or in a water-dispersible form such as an emulsion. For one embodiment, the cationic polymer may be about 1 to about 8 percent of image-receiving layer 120 by weight, and preferably about 2 to about 5 percent of image-receiving layer 120 by weight.

For other embodiments, image-receiving layer 120 may further include a metallic salt as a co-fixative. The metallic salt may include water-soluble mono- or multi-valent metallic salts. The metallic salt may include cations, such as Group I metals, Group II metals, Group III metals, or transition metals. In particular, for one embodiment, the metallic cation may include, but is not limited to, sodium, calcium, copper, nickel, magnesium, zinc, barium, iron, aluminum and chromium ions. In another embodiment, the metallic cation may include calcium, magnesium, and aluminum. An anion species, for another embodiment, may include, but is not limited to, chloride, iodide, bromide, nitrate, sulfate, sulfite, phosphate, chlorate, acetate ions, or various combinations thereof. For one embodiment, the metallic salt may be about 5 to about 20 percent of image-receiving layer 120 by weight and preferably about 6 to about 12 percent of image-receiving layer 120 by weight.

It is believed that a "blocking" effect of pigment particles 150 and the sub-micron porous structure produced by particles 160 acting together with the marking material fixative, e.g., the cationic polymer, and the co-fixative, e.g., the metallic salt, act to effectively immobilize the colorant portion of an ink deposited on image-receiving layer 120, thus keeping the colorant at or near the outer surface of image-receiving layer 120. Specifically, pigment particles 150 physically block the colorant of an ink formulation to retain the colorant at or near the outer surface of image-receiving layer 120. The fixatives chemically, physically, or electrostatically bind the colorant at or near the outer surface of image-receiving layer 120. Particles 160 absorb the ink vehicle of the ink formulation and direct the ink vehicle to substrate 110. Particles 160 also act to retain the colorant at or near the outer surface of image-receiving layer 120. This acts to increase the color gamut and the optical density of the ink. The sub-micron porous structure produced by particles 160 also acts to produce a capillary effect that enables the ink vehicle (or carrier) portion of the ink to be absorbed quickly into substrate 110, thus reducing ink bleeding, image smearing and smudge, and ink colorescience.

For one embodiment, pigment-containing layer 120 is formed by coating substrate 110 with a coating solution that includes pigment particles 140, 150, and 160, binder 170 contained in a liquid, such as water, e.g., as a suspension. For another embodiment, the coating may also contain one or more marking material fixatives, as described above. For one embodiment, image-receiving layer 120 is formed on substrate 110 with a dried coating weight of about 3 to about 15 gram/m$^2$, and preferably from about 6 to about 10 gram/m$^2$. For another embodiment, the viscosity of the coating solution is about 200 centipoise to about 1000 centipoise at a solid content of about 20 to about 60 percent by weight.

For another embodiment, the coating may be applied using a conventional off-line coater and surface sizing unit, such as a puddle-size press, film-size press, or the like. The surface sizing coating enables the coating corresponding to image-receiving layer 120 to be applied as part of a continuous process in paper machine and thus eliminates the multiple steps of forming image-receiving layer 120 by a stand-alone coater.

The puddle-size press may be configured as having horizontal, vertical, and inclined rollers. In another embodiment, the film-size press may include a metering system, such as gate-roll metering, blade metering, Meyer rod metering, or slot metering. For some embodiments, a film-size press with short-dwell blade metering may be used as application head to apply coating solution. Metering sizing acts to control an extent of penetration of the coating into substrate 110 and also enables higher coat weights to be applied on the surface of substrate 110. For one embodiment, for the puddle-size press, the viscosity of the coating is about 200 centipoise, and the solid content is about 25 to about 30 percent by weight. In another embodiment, for size presses involving metering, the viscosity of the coating is about 850 centipoise and a solid content of about 48 to about 55 percent by weight.

Subsequently, the coating (image-receiving layer 120) is dried, e.g., using infrared heating or heated air or a combination thereof. Other conventional drying methods and equipment can also be used as known in the art. For one embodiment, substrate 110 with image-receiving layer 120 formed thereon is passed between a pair of rollers, as part of a calendering process, after drying image-receiving layer 120. The calendering device can be a separate super-calendering machine, an on-line, soft-nip calendering machine, an off-line, soft-nip calendering machine, or the like.

Embodiments of the invention provide a media sheet, such as media sheet 100, having an image-receiving layer, such as image-receiving layer 120, formed on a substrate (or base stock), such as substrate 110. The image-receiving layer includes a first pigment having pigment particles, such as pigment particles 140, act to increase a solid content of a liquid coating solution that forms image-receiving layer 120, while maintaining a suitably low viscosity of the liquid coating solution, e.g., such that the liquid coating solution can be applied by surface-sizing equipment. This pigment also acts to fill some pores partially in the substrate. The second pigments including in layer 120 are plate-like pigment particles, such as pigment particles 150, that cover fibers of the substrate, and a third pigment having pigment particles, such as pigment particles 160, that control the porosity of the imaging-receiving layer and thus of the media sheet.

For one embodiment, the image-receiving layer is applied to the substrate as a liquid coating. For another embodiment, the liquid coating is formed as part of a surface sizing process using conventional surface sizing equipment. For some embodiments, pigment particles 140 act to increase solid content but maintain a viscosity of the liquid coating at a level low enough so that surface-sizing equipment can apply the liquid coating as a continuous step of the base stock formation process, thereby avoiding stopping or slowing down the base stock formation process. Pigment particles 140 also provide a solid content in the formed image-receiving layer 120 that produces a gloss level that is comparable to the gloss levels attained in image-receiving layers formed from coatings with viscosities that are too high to be used in conventional sizing equipment so that the coatings need to be applied using separate coating machinery.

CONCLUSION

Although specific embodiments have been illustrated and described herein it is manifestly intended that the scope of the claimed subject matter be limited only by the following claims and equivalents thereof.

What is claimed is:

1. A media sheet, comprising:

a porous paper substrate; and an image-receiving layer disposed directly on the substrate, the image-receiving layer comprising a mixture including:

a first pigment which is about 10 to 50% of the image-receiving layer by weight and having particles with a size of 50 to about 400 nanometers;

a second pigment having particles with a plate-like shape and a median equivalent spherical diameter of about 0.9 micron to about 1.6 microns; and a third pigment having either a first porous structure with an oil absorption of about 50 to about 300 cubic centimeters of oil per 100 grams of the third pigment, or a second porous structure comprising substantially non-porous particles.

2. The media sheet of claim 1, wherein the particles of the first pigment are selected from the group consisting of isometric particles, cubical particles, and spherical particles.

3. The media sheet of claim 1, wherein the particles of the first pigment have an aspect ratio of about 1 to about 5.

4. The media sheet of claim 1, wherein the first pigment has oil absorption of less than about 60 grams per 100 grams of the first pigment.

5. The media sheet of claim 1, wherein the particles of the second pigment have an aspect ratio of about 10 to about 50.

6. The media sheet of claim 1, wherein the substantially non-porous particles of the second porous structure of the third pigment have an aspect ratio of about 20 to about 250 and an equivalent spherical diameter of about 0.1 to about 0.8 microns.

7. The media sheet of claim 1, wherein the image-receiving layer further comprises first and second fixatives.

8. The media sheet of claim 7, wherein first and second fixatives are respectively a cationic polymer and a metallic salt.

9. The media sheet of claim 8, wherein the cationic polymer is about 1 to about 8 percent of the image-receiving layer by weight and the metallic salt is about 5 to about 20 percent of the image-receiving layer by weight.

10. The media sheet of claim 8, wherein the cationic polymer is selected from the group consisting of a primary amino group, a secondary amino group, a tertiary amino group, a quaternary ammonium salt group, a quaternary phosphonium salt group, and polyguanidine compounds.

11. The media sheet of claim 8, wherein the metallic salt comprises water-soluble mono- or multi-valent metallic salts of Group I metals, Group II metals, Group III metals, or transition metals.

12. The media sheet of claim 1, wherein the second and third pigments are respectively about 20 to about 60 percent of the image-receiving layer by weight, and about 20 to about 50 percent of the image-receiving layer by weight.

13. The media sheet of claim 1, wherein particles of the first porous structure of third pigment an equivalent spherical diameter of about 0.3 micron to about 2.0 microns.

14. The media sheet of claim 1, wherein the first porous structure of the third pigment is selected from a group consisting of structured clay and structured kaolin clay.

15. The media sheet of claim 1, wherein the second porous structure of the third pigment is aragonite precipitated calcium carbonate.

16. The media sheet of claim 1, wherein the image-receiving layer has a gloss of about 35 to about 70, as measured at a TAPPI angle of 75 degrees.

17. The media sheet of claim 1, wherein the substantially non-porous particles of the second porous structure of the third pigment have a needle-like shape.

18. The media sheet of claim 1, wherein said image-receiving layer further comprises a surface sizing agent.

19. The media sheet of claim 1, wherein said image-receiving layer has a coat weight of about 3 to 10 $g/m^2$.

20. The media sheet of claim 1, wherein said image-receiving layer is formed by a method comprising:

as a continuous step of a substrate formation process, using a surface-sizing unit to apply directly onto said substrate a liquid coating mixture comprising a liquid and an inorganic particle component comprising:

a first pigment having particles with a size of 50 to about 400 nanometers;

a second pigment having particles with a plate-like shape; and a third pigment having either a first porous structure with an oil absorption of about 50 to about 300 cubic centimeters of oil per 100 grams of the third pigment, or a second porous structure comprising substantially non-porous particles, said liquid coating mixture having a viscosity in the range of about 200 to about 1000 centipoise;

drying the coating on the substrate to form an image-receiving layer on the substrate having a coat weight of about 3 to 10 $g/m^2$; and calendering the resulting substrate with the dried image-receiving layer thereon.

21. The media sheet of claim 20, wherein said liquid coating mixture further comprises a surface sizing agent.

* * * * *